US006656672B2

(12) United States Patent
Bringley et al.

(10) Patent No.: US 6,656,672 B2
(45) Date of Patent: Dec. 2, 2003

(54) IMAGING ELEMENT CONTAINING INCORPORATED PHOTOGRAPHICALLY USEFUL COMPOUNDS

(75) Inventors: Joseph F. Bringley, Rochester, NY (US); Manju Rajeswaran, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 17 days.

(21) Appl. No.: 10/036,672

(22) Filed: Dec. 21, 2001

(65) Prior Publication Data

US 2003/0148233 A1 Aug. 7, 2003

(51) Int. Cl.[7] ..... G03C 1/08

(52) U.S. Cl. ..... 430/543

(58) Field of Search ..... 430/567, 568, 430/543, 570, 551, 599, 607, 559

(56) References Cited

U.S. PATENT DOCUMENTS

| | | | |
|---|---|---|---|
| 3,541,124 | A | 11/1970 | Owens |
| 3,719,611 | A | 3/1973 | Topol et al. |
| 5,372,919 | A | 12/1994 | Nielsen et al. |
| 5,759,762 | A | 6/1998 | Budz et al. |
| 5,827,637 | A | 10/1998 | Uchida et al. |
| 5,827,638 | A | 10/1998 | Tsukahara et al. |
| 5,856,079 | A | 1/1999 | Royster, Jr. et al. |
| 5,856,080 | A | 1/1999 | Royster, Jr. et al. |
| 5,866,314 | A | 2/1999 | Royster, Jr. et al. |
| 5,871,896 | A | 2/1999 | Royster, Jr. et al. |
| 6,261,757 | B1 | 7/2001 | Irving et al. |

FOREIGN PATENT DOCUMENTS

| | | |
|---|---|---|
| EP | 523 470 | 1/1993 |
| EP | 881 531 A1 | 12/1998 |
| EP | 881 532 A1 | 12/1998 |

OTHER PUBLICATIONS

Research Disclosure No. 12924; Jan. 1975; pp. 27–30; "Incorporated Dye–Forming Blocked Developers"; William R. Schleigh et al.

*Primary Examiner*—Geraldine Letscher
(74) *Attorney, Agent, or Firm*—Andrew J. Anderson

(57) ABSTRACT

A radiation sensitive imaging element is described comprising a support bearing one or more hydrophilic colloid layers, wherein a photographically useful compound is incorporated into at least one hydrophilic colloid layer in the form of a self-assembled composition comprising a substantially homogeneous and ordered array of the photographically useful compound and silver and halide atoms, wherein the average minimum distance from each Ag atom in the composition to an atom of the photographically useful compound in the composition is less than 50 Å. In a particular embodiment, the self-assembled composition is of the general unit cell formula $$Ag_aX_b(PUC^*)_c.nH_2O$$

where X represents halogen atoms selected from Cl, Br, and I or any combination thereof, and PUC* is a photographically useful compound containing at least one positively charged onium ion group; and wherein a is an integer from 1–10 and b is an integer from 2–18, with the proviso b is greater than a, and the silver and halide atoms form silver halide sublattice structures having a net negative charge; c is an integer such that the onium ion group containing photographically useful compound forms a positively-charged sublattice which stabilizes the negatively charged silver halide sublattice, wherein charge neutrality for the composition is upheld; and n is any number from 0 to 10. The invention provides novel materials and a method of incorporating active chemistry compounds such as developers or development inhibitors directly into a photographic imaging element. The invention further provide materials, and a method for preparing materials, comprising silver halide co-crystallized with photographic useful compound molecules thereby creating a unique crystal lattice. The invention described herein provides materials in which active chemistry and silver halide are present together in an ordered array, or crystal lattice, separated by distances measured on the atomic scale (i.e., in angstroms (Å), where 1 Å=$10^{-4}$ $\mu$m).

35 Claims, 5 Drawing Sheets

IMAGING ELEMENT CONTAINING INCORPORATED PHOTOGRAPHICALLY USEFUL COMPOUNDS

FIELD OF THE INVENTION

The present invention relates to a method of incorporating photographically useful compounds into a hydrophilic colloid layer of an imaging element, to self-assembled compositions of silver halide and photographically useful compounds, and to radiation sensitive imaging elements containing such self-assembled compositions incorporated therein.

BACKGROUND OF THE INVENTION

Substances necessary for obtaining a photographic image or compounds for obtaining a photographic image of higher quality are called photographically useful compounds. The photographic process, in its most basic form, is comprised of silver halide (capable of detecting light and storing it as latent image) and developer molecules (capable of converting the latent image to a visible image). These two chemistries, however, are incompatible, as unexposed silver halide is thermodynamically unstable with respect to reduction in the presence of developer molecules. Silver halide may also be unstable with respect to other additional photographically useful compound chemistries, which we will refer to using the term "active chemistry". Examples of other potentially active chemistries in addition to developing agents include auxiliary developing agents, development accelerators, dyes, fogging agents, silver halide solvents, couplers, compounds which accelerate coupling reaction of couplers, bleaching accelerators, fixing accelerators and development inhibitors. The consequence of this is that many photographic components must be kept separate, each function performed in sequence and thus, modern photography requires multiple steps: exposure and processing.

Incorporation of active chemistry directly into film formulations, to either simplify or improve processing after exposure, has long been a goal in the photographic industry. Some photographically useful compounds are difficult to incorporate in a stable fashion into a light-sensitive material, however, or cause serious deterioration in the photographic capability if incorporated. These compounds, if incorporated directly into the photographic elements, typically need to be stabilized or rendered harmless by chemical modification prior to photographic processing. Methods of incorporating development and other active chemistries into photographic element formulations have been described in a number of patents and publications. Schleigh and Faul, in Research Disclosure 129 (1975) describe methods of appending color developers with "blocking" chemistry to prevent premature reaction. U.S. Pat. No. 6,261,757 to Irving et al. describes photographic articles in which developers and other photographic chemistries are ionically bound to the surface of ion-exchange resins. In each of these methods, including the conventional photographic process, silver halide and active chemistry are physically separated (by distances on the order of microns, or much more), such that diffusing or mixing the two together requires the application of a relatively large amount of energy, e.g., in the form of chemical solutions or heat. However, in such prior art methods imaging elements obtained are still frequently subject to poor keeping characteristics.

It would be desirable to provide alternative methods for obtaining an imaging element with active chemistry photographically useful compounds directly incorporated therein, which exhibits good photographic performance as well as excellent keeping characteristics. It would be further desirable to provide materials capable of detecting imagewise scattered actinic radiation, storing the detected image as latent image, and further capable of developing said latent image to obtain an image. Accordingly, it would be desirable to provide a methodology whereby incorporated active chemistry in an imaging element may be "switched off", and thus rendered inert, and later "switched on" to perform a desired function.

SUMMARY OF THE INVENTION

In accordance with one embodiment of the invention, a radiation sensitive imaging element is described comprising a support bearing one or more hydrophilic colloid layers, wherein a photographically useful compound is incorporated into at least one hydrophilic colloid layer in the form of a self-assembled composition comprising a substantially homogeneous and ordered array of the photographically useful compound and silver and halide atoms, wherein the average minimum distance from each Ag atom in the composition to an atom of the photographically useful compound in the composition is less than 50 Å. In a particular embodiment, the self-assembled composition is of the general unit cell formula $$Ag_aX_b(PUC^*)_c.nH_2O$$

where X represents halogen atoms selected from Cl, Br, and I or any combination thereof, and PUC* is a photographically useful compound containing at least one positively charged onium ion group; and wherein a is an integer from 1–10 and b is an integer from 2–18, with the proviso b is greater than a, and the silver and halide atoms form silver halide sublattice structures having a net negative charge; c is an integer such that the onium ion group containing photographically useful compound forms a positively-charged sublattice which stabilizes the negatively charged silver halide sublattice, wherein charge neutrality for the composition is upheld; and n is any rational number from 0 to 10. Further embodiments of the invention are directed towards self-assembled compositions of silver halide and photographically useful compounds as described, as well as to a method for preparing a radiation sensitive imaging element, comprising forming the self-assembled compositions, adding the self-assembled composition to a hydrophilic colloid layer coating composition, and coating the hydrophilic colloid layer coating composition to form a layer of the imaging element.

The invention provides novel materials and a method of incorporating active chemistry compounds such as developers or development inhibitors directly into a photographic imaging element. The invention further provides materials, and a method for preparing materials, comprising silver halide co-crystallized with photographic useful compound molecules thereby creating a unique crystal lattice. The invention described herein provides materials in which active chemistry and silver halide are present together in an ordered array, or crystal lattice, separated by distances measured on the atomic scale (i.e., in angstroms (Å), where 1 Å=$10^{-4}$ $\mu$m).

DETAILED DESCRIPTION OF THE INVENTION

Figure 1A:
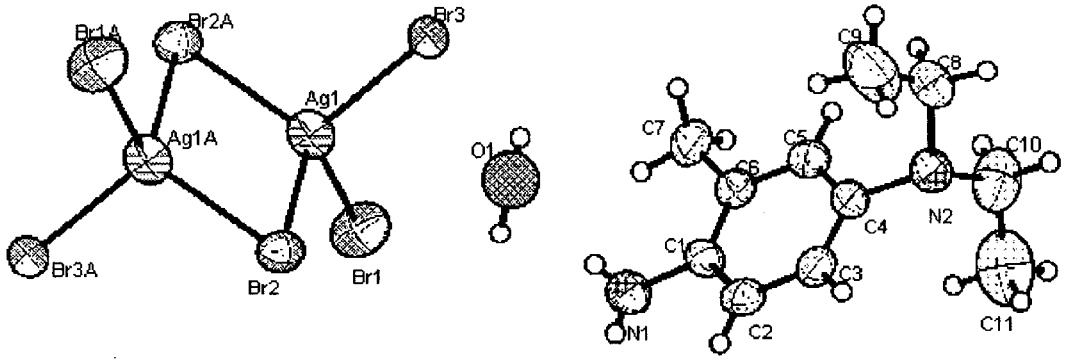
FIG. 1*a* illustrates the atomic structure of the N,N-diethyl-2-methyl-1,4-benzenediamine silver bromide dihydrate composition formed in Example 1, showing 50% probability displacement ellipsoids and the atomic numbering scheme.

In accordance with one embodiment of the invention, a photographically useful compound is incorporated into at least one hydrophilic colloid layer of an imaging element in the form of a composition comprising a substantially homogeneous and ordered array of the photographically useful compound and silver and halide atoms. The ordered array, or crystal lattice, may be of the general unit cell formula $$Ag_aX_b(PUC^*)_c.nH_2O$$

where X may be any combination of Cl, Br, and I, PUC* is a photographically useful compound containing at least one onium ion group, a is an integer from 1–10, b is an integer from 2–18, with the proviso b is greater than a, c is an integer chosen such that charge neutrality is upheld, and n is any number from 0 to 10, wherein the average minimum distance from each Ag atom to an atom of the photographically useful compound is less than 50 Å. The co-crystallized compositions are distinguished from conventional photographic silver halide crystal grains of the face-centered cubic lattice structure, wherein essentially equal numbers of silver and halide atoms make up the crystal lattice. The co-crystallized compositions are further distinguished from conventional photographic silver halide crystal grains having photographically useful compounds absorbed to the surface, wherein the minimum distance from internal Ag atoms of the crystal grains to the photographically useful compounds on the grain surface is typically substantially more than 50 Å.

In order to facilitate self-assembly of a desired photographically useful compound into a homogeneous and ordered array of the photographically useful compound and silver and halide atoms in accordance with the invention, the photographically useful compound is selected or modified to contain at least one atom group capable of forming an onium ion group. Examples of such groups include amine, phosphine, arsenine and sulfide groups, which contain N, P, As or S atoms capable of forming an onium ion. Preferred groups are tertiary amine and phosphine groups, which contains a quaternizable N or P atom capable of forming an ammonium or phosphonium ion group, more preferably an ammonium ion group. In such embodiments, PUC* in the self-assembled composition may be represented by the formula ($PUC\text{-}N^+R_3$) where each R is independently H or an organic substituent group and PUC represents the remaining fragment of the photographically useful compound.

The self-assembled crystal lattice compositions may be formed by combining solutions containing silver and halide ions and the desired photographically useful compound containing an onium ion forming group together under acidic conditions. The term acidic conditions may apply to an aqueous or non-aqueous system such that the conditions provide for the formation of an onium ion of the photographically useful compound. Self-assembly of silver halide and photographically useful compound produces composites wherein clusters or "slices" of a silver halide sublattice having a net negative charge (as b is greater than a) are stabilized by a counter-charged sublattice made up of the protonated onium ion group containing photographically useful compound.

Figure 1B:
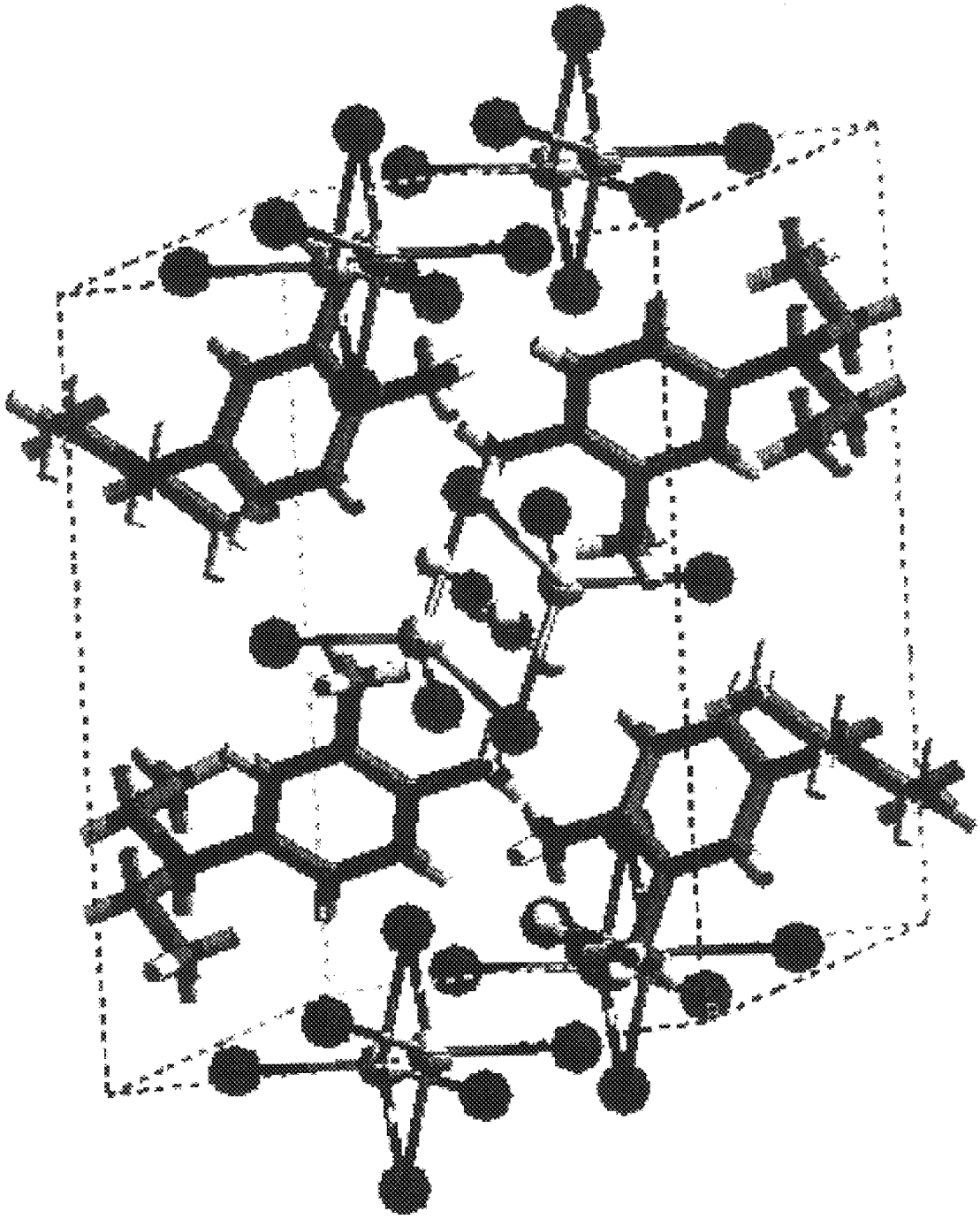
FIG. 1*b* shows the contents of a single unit-cell of the N,N-diethyl-2-methyl-1,4-benzenediamine silver bromide dihydrate composition formed in Example 1.
Figure 2A:
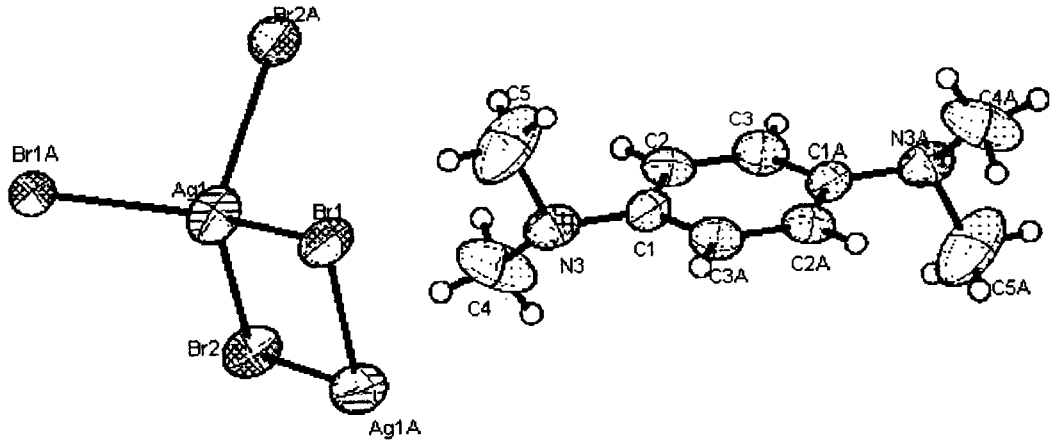
FIG. 2*a* illustrates the atomic structure of the N,N,N',N'-tetramethyl-1,4-benzenediamine silver bromide composition formed in Example 3, showing 50% probability displacement ellipsoids and the atomic numbering scheme.
Figure 2B:
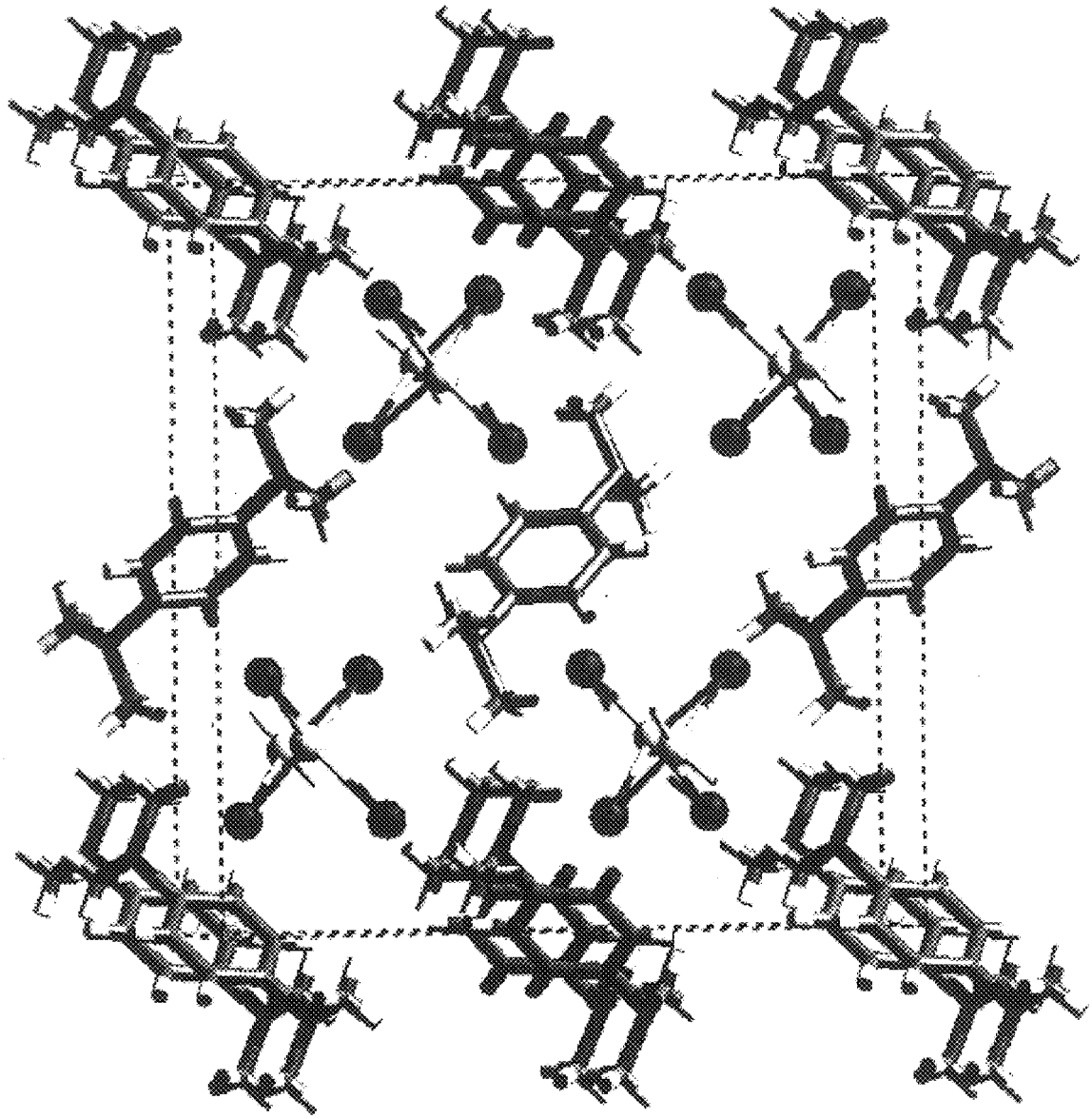
FIG. 2*b* shows the contents of a single unit-cell of the N,N,N',N'-tetramethyl-1,4-benzenediamine silver bromide composition formed in Example 3.

Depending upon the structure and number of charged groups on the photographically useful compound, the self-assembled compositions of PUC* and silver and halide atoms may take various crystalline forms. In preferred embodiments, the photographically useful compound contains either 1 or 2 onium ion forming groups. Where PUC contains two onium ion forming groups, e.g., the unit cell structure of the self-assembled compositions may be of the formula $Ag_2X_6(PUC{:}2H^+)_2.H_2O$, where $PUC{:}2H^+$ represents the di-protonated form of the photographically useful compound. A representation of such unit cell structure is depicted in FIG. 1*b,* where the PUC is color developer compound CD-2 (N,N-diethyl-2-methyl-1,4-benzenediamine). Alternatively, the unit cell structure of the self-assembled compositions where PUC contains two onium ion forming groups may be of the formula $Ag_2X_4(PUC{:}2H^+)$. A representation of such unit cell structure is depicted in FIG. 2*b*, where PUC is auxiliary developer compound N,N,N',N'-tetramethyl-1,4-benzenediamine. Representative unit cell structure formulas for self-assembled compositions comprising photographically useful compounds having a single onium ion forming group include $Ag_3X_7(PUC{:}H^+)_4$ and $Ag_2X_4(PUC{:}H^+)_2$. In general, the ordered crystalline form of the compounds can take on a variety of structures, the examples given above being meant to illustrate specific embodiments, but not being intended to limit the scope of possible structures and combinations of structures. One skilled in the art may apply the synthesis techniques described herein to characterize the compounds and structures formed using the general approaches described.

In accordance with the invention, silver halide and photographically useful compound self-assembled compositions may be incorporated into at least one hydrophilic colloid layer in a radiation sensitive imaging element. As it includes silver and halide atoms in the form of a silver halide sublattice, the co-crystallized compositions themselves may be radiation sensitive, or they may be used in combination with other conventional radiation sensitive materials. In accordance with a specific embodiment of the invention, the self-assembled composition may be contained in a hydrophilic colloid layer which also contains a conventional photographic silver halide emulsion comprised of radiation sensitive silver halide grains exhibiting a silver halide face centered cubic crystal lattice structure, or in a hydrophilic colloid layer adjacent to a photographic silver halide emulsion layer comprised of radiation sensitive silver halide grains exhibiting a silver halide face centered cubic crystal lattice structure.

Photographically useful compounds which may be incorporated into a homogeneous and ordered array of the photographically useful compound and silver and halide atoms for incorporation into at least one hydrophilic colloid layer of an imaging element in accordance with the invention include photographic developing agents, auxiliary developing agents, development accelerators, dyes, fogging agents, silver halide solvents, couplers, compounds which accelerate coupling reaction of couplers, bleaching accelerators, fixing accelerators, electron transfer agents, antifogging agents, keeping agents, sequestraints, chemical sensitizers and development inhibitors, or other organic molecules capable of performing a photographic function. The selection and/or modification of appropriate photographically useful compound molecules to meet the criteria of containing an onium ion group under acidic conditions will be readily apparent to one skilled in the art.

The invention is particularly useful in the context of incorporating active chemistry in the form of developing agents (e.g., catechol, hydroquinone, aminophenol, sulfonamidophenol, aminopyrazolone, phenylenediamine, ascorbic acid derivative), auxiliary developing agents (e.g., 1-phenylpyrazolidin-3-one derivative), development accelerators (e.g., mesoionic compound), fogging agents, antifogging agents (e.g., dinitrobenzoic acid, 4-carboxymethyl-4-thiazoline-2-thione), chemical sensitizers (e.g., aurous thiomalate), silver halide solvents, photographic couplers, or development inhibitors (e.g., benzotriazole, 5-mercaptotetrazole, 2-mercapto-1,3,4-thiadiazole derivative), and especially developing agents, auxiliary developing agents or development inhibitors, which compounds have been particularly problematic upon incorporation into photographic elements with respect to providing good photographic performance upon processing while maintaining excellent keeping characteristics.

In accordance with one particularly preferred embodiment of the invention, the photographically useful compounds may comprise molecules commonly used as developer agents or auxiliary developing agents in the photographic art. The developer molecules may be any developer selected from those commonly known in the art. A detailed description of photographic development chemistry is given in "*The Theory of the Photographic Process*", T. H. James, 4th ed. Eastman Kodak Company, Chapters 11–15, (1977). Specific examples of developing agents and the auxiliary developing agents include hydroquinones, catechols, p-aminophenols, p-phenylenediamines, 1-phenyl-3-pyrazolidones, reductones, sulfonamidophenols, sulfonamidonaphthols, aminohydroxypyrazoles, aminopyrazolines, hydrazines and hydroxylamines. Among these, preferred black and white development agents are hydroquinones and their derivatives, para-aminophenols and ascorbic acid. Preferred color developer molecules include para-phenylenediamine and derivatives thereof. Inorganic developing agents include hydroxylamine, compounds of $Sn^{2+}$, dithionite and hydrazine. In accordance with preferred embodiments, PUC* in the self-assembled composition represents a photographic developer compound of the formula ($R_3N^+$—L—$N^+R_3$) where each R is independently H or an organic substituent group and L represents a phenylene or an other linking group with conjugated double bonds, with para-phenylenediamine and derivative compounds thereof being particularly preferred.

In accordance with another embodiment of the invention, molecules commonly used as development inhibitors in the photographic process can be incorporated into co-crystallized silver halide compositions as discussed above. The inhibitor molecules may be based upon any inhibitor selected from those commonly known in the art. Common photographic inhibitors include 1-phenyl-5-mercaptotetrazole (PMT), 5-mercaptotetrazole, benzotriazole (BTAZ), benzimidazole (BZ), 2-mercaptobenzothiazole, 2-mercaptobenzoxazole, 2-mercaptothiazoline, diethyldithiocarbamate, and iodide ions. A co-crystallized silver halide composition can generally be prepared with an inhibitor if it contains, or is modified to contain, a charged group. Inhibition chemistry is commonly used in photographic systems to manipulate photographic properties such as tone scale, contrast, fog and color. Inhibition chemistry, as the word implies, generally slows the rate of development of silver halide imaging elements, and while allowing a film designer to manipulate the properties mentioned above, generally results in an overall loss of system photographic speed and contrast when incorporated in a photographic element. This is because the free inhibitor when added to photographic grains strongly absorbs to their surfaces and "inhibits" developer chemistry from gaining access to the surfaces. The present invention provides a method of inhibiting development which does not result in an overall speed loss but still allows control of contrast, as when the inhibitor chemistry is incorporated in the form of co-crystallized silver halide compositions it is thus sequestered from any additional imaging silver halide. The co-crystallized materials effectively isolate the inhibitor from any conventional imaging silver halide grains until the time of development, at which time the inhibitor chemistry is released and interacts with the system.

In accordance with another embodiment of the invention, molecules commonly used as antifogging agents in the photographic process can be incorporated into co-crystallized silver halide compositions as discussed above. The antifogging molecule may be based upon any antifoggant selected from those commonly used in the art. Common photographic antifoggants include dinitrobenzoic acid, 4-carboxymethyl-4-thiazoline-2-thione, 2-mercaptobenzothiazole, 3-isothiuronium-propane sulfonate, and p-glutaramidophenyl disulfide. Antifoggants commonly are employed to reduce the minimum density or fog level of a photographic coating. However, the addition of such addenda often results in a photographic speed loss. The present invention provides a method of incorporating antifoggant which does not result in an overall speed loss, as when the antifogging chemistry is incorporated in the form of co-crystallized silver halide compositions it is thus sequestered. The co-crystallized silver halide compositions effectively isolate the antifoggant from any conventional imaging silver halide grains until the time of development, at which time the antifogging chemistry is released and interacts with the system.

In accordance with the invention, unique chemical lattice structures are described containing silver halide co-crystallized with active photographic chemistries. These materials are uniquely characterized in that silver atoms within the crystal lattice are separated from reactive photographically useful compound molecules by atomic distances on the order a few angstroms. What is perhaps most remarkable is that the materials of the invention are stable in the absence light, that is to say that the developer molecules or other active chemistry are incapable of performing their normal photographic function within the crystal lattice. However, the invention provides a method for "switching" on the photographic function of the photographically useful compound molecule, at which point the photographic function proceeds extremely rapidly as a result of the atomic proximity of the silver ions and active photographic chemistry. While not being limited, we propose the following theory to explain the behavior of the materials of the invention.

It is well known that development rates, and the rate of other photographic chemistries, are highly dependent upon the pH of the system. For example, the pH of commercial developer solutions is typically between 10–12 (i.e., very basic). This is an intrinsic property of photographic systems and is a direct result of their chemical properties. In acidic media, development rates are orders of magnitude slower. The co-crystallized materials of the present invention are prepared in acidic media, and thus the onium ion forming groups of the photographically useful compound molecules are fully protonated. Further, it is well known that silver halide is a strong lewis acid. Thus, the active chemistry is crystallized in a highly acidic environment. The environment and protonation of the photographically useful compound molecules in the materials of the invention shuts down their ability to reduce (or otherwise interact with) silver ions, and thus stabilizes the compound against spontaneous decomposition. Upon pH switch, as in photographic development, the compounds are rapidly converted back to silver halide active chemistry, as in the general eqn. 1, where the photographically useful compound containing an onium ion group is represented by an organoammonium compound.

$$Ag_aX_b(\text{organoammonium})_c+NaOH \rightarrow AgX+\text{organoamine}+NaX \quad (1)$$

The organoamine, such as a color developer, is then free to perform the desired photographic function. This process is extremely rapid because the photographic molecules are dispersed within the compounds at atomic distances.

After self-assembly, the resulting composition may be recovered by filtration, centrifugation or other means and may be washed free of any unincorporated photographically useful compound molecules and may then be stored until which time it is prepared for incorporation into an imaging element. The compositions may be added as a free solid or may be prepared by dispersing the solid into water or non-aqueous medium or into an aqueous hydrophilic colloid medium such as gelatin, or into a hydrophobic or hydrophilic polymer medium.

Co-crystallized compositions of silver halide and photographically useful compounds prepared in accordance with the invention may be incorporated in imaging element hydrophilic colloid layer coating compositions. A typical photographic light-sensitive imaging material is based on hydrophilic colloid layers comprising silver halide emulsion compositions, though other types of materials are known using various other kinds of light-sensitive components. The co-crystallized silver halide and photographically useful compound compositions may be incorporated into a light sensitive emulsion layer or any other hydrophilic colloid layer.

Photographically useful compound compositions prepared in accordance with the invention may be useful for single color elements (including black and white) or multicolor photographic elements. Silver halide multicolor elements typically contain a support and image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. Various arrangements and constructions of silver halide color photographic materials may be employed for different types of imaging processes including, for example, diffusion transfer color photography and silver dye bleach color photography. Mixed grain photographic products and multilayer products are also known.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. If desired, a photographic element containing a dispersed photographically useful compound in accordance with the invention can be used in conjunction with an applied magnetic layer as described in *Research Disclosure,* November 1992, Item 34390 published by Kenneth Mason Publications, Ltd., Dudley House, 12 North Street, Emsworth, Hampshire P010 7DQ, ENGLAND.

Suitable materials for use in photographic emulsions and elements that can be used in conjunction with co-crystallized silver halide and photographically useful compound compositions prepared in accordance with the invention are further described in *Research Disclosure,* September 1994, Item 36544, available as described above. The contents of the *Research Disclosure,* including the patents and publications referenced therein, are incorporated herein by reference, and the Sections hereafter referred to are Sections of the *Research Disclosure,* Item 36544. Conventional silver halide imaging emulsions which may be employed in photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX. It is also specifically contemplated that the materials and processes described in an article titled "Typical and Preferred Color Paper, Color Negative, and Color Reversal Photographic Elements and Processing," published in *Research Disclosure,* February 1995, Volume 370 may also be advantageously used with elements and compositions prepared in accordance with the invention. It is further specifically contemplated that the elements and compositions of the invention may further be used in combination with the various photographic compounds and systems such as described in U.S. Pat. No. 6,261,757 to Irving, et al., the disclosure of which is incorporated herein.

The hydrophilic colloid in the hydrophilic colloid layers of the element of the present invention is a binder or protective colloid for the usual silver halide photographic light-sensitive materials. Gelatin is most preferably used as binder or protective colloid in the present invention, though, of course, other hydrophilic colloids may also be used. Other suitable hydrophilic materials include, for example, gelatin derivatives, graft copolymers comprising gelatin and other polymeric materials, albumin, casein and other forms of protein, cellulose derivatives such as hydroxyethyl cellulose, carboxymethyl cellulose, the sulfuric acid ester of cellulose, etc., carbohydrate derivatives such as sodium alginate, starch and its derivatives, etc., various synthetic polymer materials such as poly(vinyl alcohol), partially acetalized poly(vinyl alcohol), poly-N-vinylpyrrolidone, poly(acrylic acid), poly(methacrylic acid), polyacrylamide, polyvinylimidazole, polyvinylpyrazole, etc., and copolymers consisting of the monomer unit contained in the above cited polymers.

Among various types of gelatin, one can use alkaline processed gelatin, acid processed gelatin, the hydrolyzed product therefrom, or the peptized product therefrom with an enzyme. Suitable gelatin derivatives include the reaction products obtained by subjecting gelatin to reactions with a number of reagents such as acid halide, such anhydride, isocyanate, bromoacetic acid, alkane sultone, vinylsulfonamide, maleinimide, polyalkylene oxide, epoxide, etc. Reference can be made to U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc. Representative hydrophilic synthetic polymeric materials include those described in, for example, German Patent Application (OLS) No. 2,312,708, U.S. Pat. Nos. 3,620,751 and 3,879,205, Japanese Patent Publication No. 7561/68.

EXAMPLES

Example 1

Preparation of $Ag_2Br_6(CD\text{-}2{:}2H^+)_2.H_2O$

CD-2 (N,N-diethyl-2-methyl-1,4-benzenediamine) is a commercial color developer molecule. Crystals of $Ag_2Br_6(CD\text{-}2{:}2H^+)_2.H_2O$ were prepared as follows: AgBr (4.00 g, 21.0 mmoles) was dissolved in 50.0 ml of warm 48% hydrobromic acid and separately N,N-diethyl-2-methyl-1,4-benzenediamine hydrogen chloride (4.51 g, 21.0 mmoles) was dissolved in 50 ml HBr. The two solutions were then combined with stirring, heated gently to about 70° C., and cooled slowly to 0° C., whereupon colorless, crystalline needles formed. The needles were then collected by filtration and washed with a small amount of 50:50 $H_2O$:HBr and dried.

The atomic structure of the N,N-diethyl-2-methyl-1,4-benzenediamine silver bromide dihydrate composition formed was determined by single crystal X-ray diffraction. This technique is described in detail in "Elements of X-ray Diffraction", B. D. Cullity, 2$^{nd}$ ed., Addison-Wesley Pub. Co., Reading, Mass. (1978). A view of the structure showing 50% probability displacement ellipsoids and the atomic numbering scheme is given in FIG. 1*a,* and the contents of a single unit-cell are illustrated in FIG. 1*b,* with Ag=yellow, Br=green, C=gray, N=blue, and O=red. The x,y,z cartesian coordinates ($\times 10^4$) of the atomic positions for each atom are given in Table 1, along with equivalent isotropic displacement. parameters U(eq) ($Å^2\times 10^3$).

TABLE 1

| | x | y | z | U(eq) |
|---|---|---|---|---|
| Ag(1) | 4195(1) | 1033(1) | 136(1) | 62(1) |
| Br(1) | 5146(1) | 3019(1) | 850(1) | 70(1) |
| Br(2) | 5045(1) | −560(1) | 1562(1) | 44(1) |
| Br(3) | 1756(1) | 1046(1) | −16(1) | 45(1) |
| N(1) | 3565(4) | −3181(5) | 2224(4) | 54(1) |
| N(2) | −1426(3) | −2809(3) | 2983(2) | 48(1) |
| C(1) | 2260(3) | −3127(4) | 2395(3) | 37(1) |
| C(2) | 1907(4) | −3622(4) | 3189(3) | 43(1) |
| C(3) | 683(4) | −3558(4) | 3370(3) | 41(1) |
| C(4) | −149(3) | −2965(4) | 2751(3) | 37(1) |
| C(5) | 218(4) | −2495(4) | 1936(3) | 42(1) |

TABLE 1-continued

| | x | y | z | U(eq) |
|---|---|---|---|---|
| C(6) | 1432(4) | −2571(3) | 1737(3) | 37(1) |
| C(7) | 1810(4) | −2082(4) | 842(3) | 53(1) |
| C(8) | −2401(4) | −3305(6) | 2269(4) | 74(2) |
| C(9) | −2197(6) | −4568(6) | 2110(5) | 95(2) |
| C(10) | −1732(5) | −1530(5) | 3150(4) | 72(2) |
| C(13) | −860(6) | −998(5) | 3924(5) | 93(2) |
| O(1) | 3606(5) | −4549(5) | 685(4) | 96(2) |

A single unit cell is shown in FIG. 1*b,* where a unit cell is the smallest repeating unit of the crystal lattice. The full structure of a crystal can be constructed from a unit cell by stacking multiple cells in three dimensions. The $Ag_2Br_6(CD\text{-}2{:}2H^+)_2.H_2O$ structure prepared consists of an interpenetrating lattice of silver bromide clusters and biprotonated color developer molecules. The silver ions are tetrahedrally coordinated by bromide ions; the tetrahedra sharing an edge with a neighboring $AgBr_4^-$ to produce $[Ag_2Br_6]^{4-}$ dimerized clusters. The clusters are held together in the crystal lattice by coulombic forces which exist between the negatively charged dimers and the positively charge biprotonated color developer molecules. The smallest distance from bromide to the protonated tertiary amine nitrogen is a short 3.58 Å. The composition of the invention thus comprises a well ordered array of silver halide clusters and color developer molecules in which the distances between the silver halide clusters and color developer molecules is measured on an atomic scale (typically only a few atoms or molecules apart). Thus the developer molecules are in extremely close contact to the silver atoms of the silver halide clusters.

Example 2

Preparation of $Ag_2I_6(CD\text{-}2{:}2H^+)_2.H_2O$

Crystals of $Ag_2I_6(CD\text{-}2)_2.H_2O$ were prepared as follows: AgI (4.00 g, 17.0 mmoles) was dissolved in 20.0 ml, 57% hydriodic acid and separately, N,N-diethyl-2-methyl-1,4-benzenediamine (CD-2) (3.66 g, 17.0 mmoles) was dissolved in 30 ml $H_2O$+40 ml HI. The two solutions were then combined with stirring, heated gently to about 40° C., and cooled slowly to 3° C., whereupon colorless, crystalline needles formed. The needles were then collected by filtration and washed with a small amount of 50:50 $H_2O$:HI and dried. Elemental analysis found (calc.) gave C=19.31% (19.29%), H=3.26% (2.94%), N=4.07% (4.09%); I=55.17% (55.59%).

Example 3

Preparation of $Ag_2Br_4(TMBD{:}2H^+)$

TMBD (N,N,N',N'-tetramethyl-1,4-benzenediamine) is an auxiliary developer molecule. Crystals of $Ag_2Br_4(TMBD{:}2H^+)$ were prepared as follows: AgBr (4.00 g, 21.0 mmoles) was dissolved in 40.0 ml, 48% hydrobromic acid and separately, N,N,N',N'-tetramethyl-1,4-benzenediamine dihydrogen chloride (5.05 g, 21.0 mmoles) was dissolved in 20 ml $H_2O$+34 ml HBr. The two solutions were then combined with stirring, heated gently to about 50° C., and cooled slowly to −4° C., whereupon colorless, crystalline needles formed. The needles were then collected by filtration and washed with a small amount of 50:50 $H_2O$:HBr and dried.

The atomic structure of the N,N,N',N'-tetramethyl-1,4-benzenediamine silver bromide composition formed was determined by single crystal X-ray diffraction. A view of the structure showing 50% probability displacement ellipsoids and the atomic numbering scheme is given in FIG. 2*a,* and the contents of a single unit-cell are illustrated in FIG. 2*b,* with Ag=yellow, Br=green, C=gray, and N=blue. The x,y,z cartesian coordinates ($\times 10^4$) of the atomic positions for each atom are given in Table 2, along with equivalent isotropic displacement parameters U(eq) ($Å^2 \times 10^3$).

TABLE 2

| | x | y | z | U(eq) |
|---|---|---|---|---|
| Ag(1) | 2563(1) | 5759(1) | 1527(1) | 58(1) |
| Br(1) | 1527(1) | 3414(1) | 751(1) | 53(1) |
| Br(2) | 3456(1) | 3275(1) | 2485(1) | 50(1) |
| N(3) | 1082(2) | 1660(4) | 3851(2) | 44(1) |
| C(1) | 525(2) | 816(5) | 4460(2) | 33(1) |
| C(2) | 480(2) | 1569(5) | 5255(2) | 39(1) |
| C(3) | −54(2) | 725(5) | 5803(2) | 40(1) |
| C(4) | 1885(2) | 1926(7) | 4216(3) | 79(2) |
| C(5) | 804(4) | 3564(7) | 3497(3) | 102(2) |

A single unit cell is shown in FIG. 2*b,* where a unit cell is the smallest repeating unit of the crystal lattice. The full structure of a crystal can be constructed from a unit cell by stacking multiple cells in three dimensions. The structure consists of silver atoms tetrahedrally coordinated by bromide atoms; the tetrahedra sharing trans edges to produce infinite one-dimensional chains of $AgBr_4$ polyhedra, having the overall composition $[Ag_2Br_4]^{2-}$. The TMBD molecules occupy the interstices between these chains and the composite structure is held together by coulomb forces and hydrogen bonds between the ammonium ions and the $[Ag_2Br_4]^{2-}$ chains. The smallest distance from bromide to the protonated tertiary amine nitrogen is a short 3.23 Å. The composition of the invention thus comprises a unique and well ordered array of silver halide chains and color developer molecules in which the distances between the silver halide chains and color developer molecules is measured on an atomic scale (typically only a few atoms or molecules apart). Thus the developer molecules are in extremely close contact to the silver atoms of the silver halide clusters.

Example 4

Preparation of $Ag_2Br_6(PPD{:}2H^+)_2$

PPD (para-phenylenediamine, or 1,4-benzenediamine) is a color developer molecule. Crystals of $Ag_2Br_6(PPD{:}2H^+)_2$ were prepared according to a general procedure similarly as in Example 1, employing PPD in place of CD-2. Elemental analysis were in good agreement with the stated composition.

Example 5

Preparation of $Ag_3Br_7$(n-hexylammonium)$_4$

Amines such as n-hexylamine have been employed as development accelerators, nucleators, and electron transfer agents. Crystals of $Ag_3Br_7$(n-hexylammonium)$_4$ were prepared according to a general procedure similarly as in Example 1, employing n-hexylamine in place of CD-2. Elemental analysis were in good agreement with the stated composition.

Example 6

Preparation of $Ag_2I_4$(formamidinium)$_2$

Crystals of $Ag_2I_4$(formamidinium)$_2$ were prepared as follows: 4.0 g of AgI was dissolved in 6.0 ml of 48% hydriodic acid at 60° C. To this solution was added 1.77 g of formamidine acetate (Aldrich Chemical Co.) in 2.0 ml 48% hydriodic acid and the solution was allowed to cool at room temperature. Upon cooling a large mass of white crystals formed. The crystals were collected by vacuum filtration. Elemental analysis were in good agreement with the stated composition.

The structures of the photographically useful compounds co-crystallized with silver halide in Examples 1–6 are given below.

| Name | Chemical formula |
|---|---|
| CD-2 | 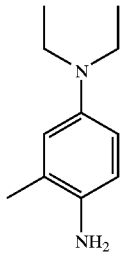 |
| PPD | 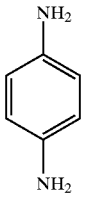 |
| TMBD | 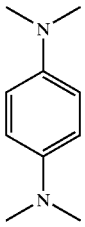 |
| Formamidinium | $H_2N^+{=}CHNH_2$ |

Example 7

Imaging Element Photographic Evaluation

A dispersion of $Ag_2Br_6(PPD{:}2H^+)_2$ was prepared as follows: 2.12 g of the co-crystallized composition $Ag_2Br_6$ (PPD:2H )$_2$ as prepared in Example 4 was dispersed in 44.9 g of distilled water which contained 4.0% gelatin by weight as a coating vehicle. To the dispersion was added 0.05 g of surfactant as a coating aid and the dispersion was stirred at 40° C. in the dark for 30 minutes. The dispersion was then coated onto a clear plastic support to give a coating which contained 0.538 g/m$^2$ of the co-crystallized composition $Ag_2Br_6(PPD{:}2H^+)_2$ and 2.15 g/m$^2$ gelatin.

Strips of the coatings were tested for photographic response by exposing them to a light source having a wavelength of 365 nm for 1/10 sec through a 21-step tablet. The strips were then developed by soaking them in an aqueous solution containing 2.5 w % NaOH for 10 seconds at 25° C. The optical density of the strips were then read using an optical densitometer. The resulting exposure versus density curve is given in FIG. 3.

Figure 3:
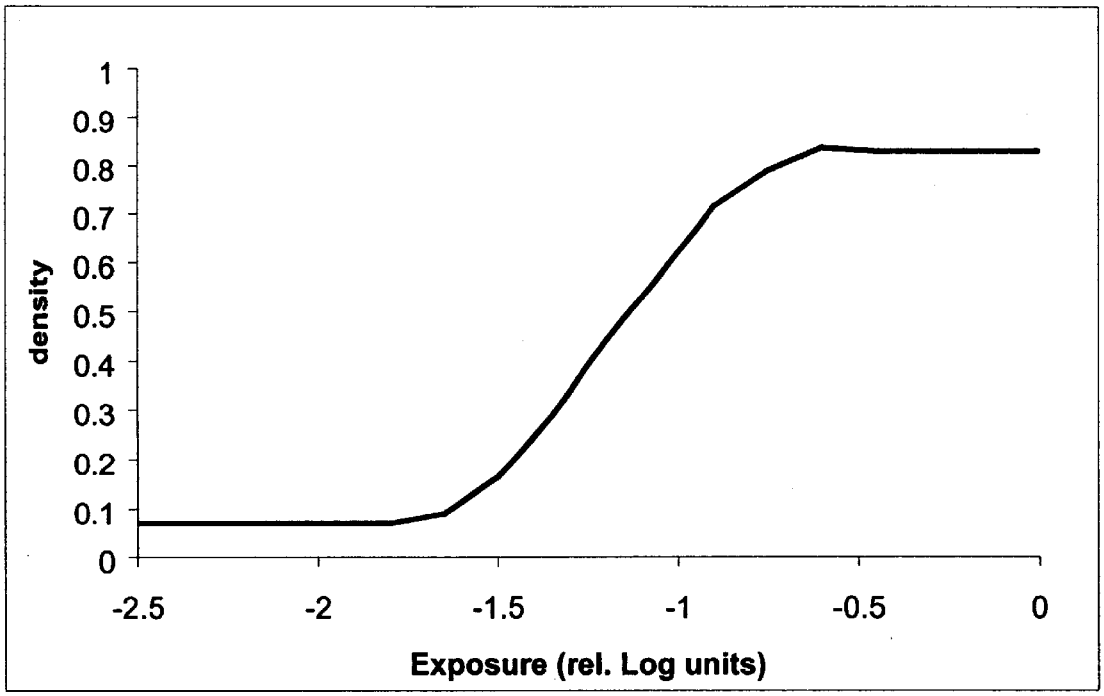
FIG. 3 illustrates the exposure versus density curve for the imaging element of Example 7 prepared in accordance with an embodiment of the invention.

The results of FIG. 3 show that the materials of the invention are capable of producing a photographic image from imagewise scattered radiation. More remarkably, the crystals of the present invention produce an image in just 10 seconds at 25° C. which is remarkably fast when compared to typical development times used in the conventional photographic process, 3 minutes and 15 seconds at 40° C.

The invention has been described in detail with particular reference to certain preferred embodiments thereof, but it will be understood that variations and modifications can be effected within the spirit and scope of the invention.

What is claimed is:

1. A radiation sensitive imaging element comprising a support bearing one or more hydrophilic colloid layers wherein a photographically useful compound is incorporated into at least one hydrophilic colloid layer in the form of a self-assembled composition comprising a substantially homogeneous and ordered array of the photographically useful compound and silver and halide atoms, wherein the average minimum distance from each Ag atom in the composition to an atom of the photographically useful compound in the composition is less than 50 Å.

2. An element according to claim 1, wherein the self-assembled composition is of the general unit cell formula $$Ag_aX_b(PUC^*)_c.nH_2O$$

where X represents halogen atoms selected from Cl, Br, and I or any combination thereof, and PUC* is a photographically useful compound containing at least one positively charged onium ion group; and wherein a is an integer from 1–10 and b is an integer from 2–18, with the proviso b is greater than a, and the silver and halide atoms form silver halide sublattice structures having a net negative charge;

c is an integer such that the onium ion group containing photographically useful compound forms a positively-charged sublattice which stabilizes the negatively charged silver halide sublattice, wherein charge neutrality for the composition is upheld; and n is any rational number from 0 to 10.

3. An element according to claim 2 wherein PUC* in the self-assembled composition is a photographically useful compound containing at least one ammonium ion group.

4. An element according to claim 2 wherein PUC* in the self-assembled composition is of the formula ($PUC\text{-}N^+R_3$) where each R is independently H or an organic substituent group and PUC represents the remaining fragment of the photographically useful compound.

5. An element according to claim 4 wherein the photographically useful compound comprises a developing agent, auxiliary developing agent, development accelerator, dye, fogging agent, silver halide solvent, coupler, compound which accelerates coupling reaction of couplers, bleaching accelerator, fixing accelerator, electron transfer agent, antifogging agent, keeping agent, sequestraint, chemical sensitizer or development inhibitor.

6. An element according to claim 4 wherein the photographically useful compound comprises a photographic developer compound.

7. An element according to claim 2 wherein PUC* in the self-assembled composition represents a photographic developer compound of the formula ($R_3N^+—L—N^+R_3$) where each R is independently H or an organic substituent group and L represents a phenylene or an other linking group with conjugated double bonds.

8. An element according to claim 7 wherein L represents a phenylene group.

9. An element according to claim 2 wherein PUC* contains one or two onium ion groups.

10. An element according to claim 2 wherein PUC* contains two onium ion groups, and the unit cell structure of the self-assembled composition is of the formula $Ag_2X_6(PUC{:}2H^+)_2.H_2O$, where $PUC{:}2H^+$ represents the di-protonated form of the photographically useful compound.

11. An element according to claim 2 wherein the unit cell structure of the self-assembled composition is of the formula $Ag_2X_6$(N,N-diethyl-2-methyl-1,4-benzenediamine:$2H^+$)$_2.H_2O$.

12. An element according to claim 2 wherein the unit cell structure of the self-assembled composition is of the formula $Ag_2X_6$(para-phenylenediammine:$2H^+$)$_2.nH_2O$.

13. An element according to claim 2 wherein PUC* contains two onium ion groups, and the unit cell structure of the self-assembled composition is of the formula $Ag_2X_4(PUC{:}2H^+)$, where $PUC{:}2H^+$ represents the di-protonated form of the photographically useful compound.

14. An element according to claim 2 wherein the unit cell structure of the self-assembled composition is of the formula $Ag_2X_4$(N,N,N',N'-tetramethyl-1,4-benzenediamine:$2H^+$).

15. An element according to claim 2 wherein PUC* contains one onium ion group, and the unit cell structure of the self-assembled composition is of the formula $Ag_3X_7(PUC{:}H^+)_4$, where $PUC{:}H^+$ represents the protonated form of the photographically useful compound.

16. An element according to claim 2 wherein PUC* contains one onium ion group, and the unit cell structure of the self-assembled composition is of the formula $Ag_2X_4(PUC{:}H^+)_2$, where $PUC{:}H^+$ represents the protonated form of the photographically useful compound.

17. An element according to claim 2 wherein the self-assembled composition is contained in a hydrophilic colloid layer which also contains a photographic silver halide emulsion comprised of radiation sensitive silver halide grains exhibiting a silver halide face centered cubic crystal lattice structure.

18. An element according to claim 2 wherein the self-assembled composition is contained in a hydrophilic colloid layer adjacent to a photographic silver halide emulsion layer comprised of radiation sensitive silver halide grains exhibiting a silver halide face centered cubic crystal lattice structure.

19. A method for preparing a radiation sensitive imaging element, comprising forming a self-assembled composition comprising a substantially homogeneous and ordered array of a photographically useful compound and silver and halide atoms, wherein the average minimum distance from each Ag atom in the composition to an atom of the photographically useful compound in the composition is less than 50 Å, adding the self-assembled composition to a hydrophilic colloid layer coating composition, and coating the hydrophilic colloid layer coating composition to form a layer of the imaging element.

20. A method according to claim 19, wherein the self-assembled composition is of the general unit cell formula $$Ag_aX_b(PUC^*)_c.nH_2O$$

where X represents halogen atoms selected from Cl, Br, and I or any combination thereof, and PUC* is a photographically useful compound containing at least one positively charged onium ion group, and wherein a is an integer from 1–10 and b is an integer from 2–18, with the proviso b is greater than a, and the silver and halide atoms form silver halide sublattice structures having a net negative charge;

c is an integer such that the onium ion group containing photographically useful compound forms a positively-charged sublattice which stabilizes the negatively charged silver halide sublattice, wherein charge neutrality for the composition is upheld; and n is any rational number from 0 to 10.

21. A self-assembled composition comprising a substantially homogeneous and ordered array of a photographically useful compound and silver and halide atoms of the general unit cell formula $$Ag_aX_b(PUC^*)_c.nH_2O$$

where X represents halogen atoms selected from Cl, Br, and I or any combination thereof, and PUC* is a photographically useful compound containing at least one positively charged onium ion group; and wherein a is an integer from 1–10 and b is an integer from 2–18, with the proviso b is greater than a, and the silver and halide atoms form silver halide sublattice structures having a net negative charge;

c is an integer such that the onium ion group containing photographically useful compound forms a positively-charged sublattice which stabilizes the negatively charged silver halide sublattice, wherein charge neutrality for the composition is upheld; and n is any rational number from 0 to 10;

wherein the average minimum distance from each Ag atom in the composition to an atom of the photographically useful compound in the composition is less than 50 Å.

22. A composition according to claim 21 wherein PUC* is a photographically useful compound containing at least one ammonium ion group.

23. A composition according to claim 21 wherein PUC* is of the formula ($PUC\text{-}N^+R_3$) where each R is independently H or an organic substituent group and PUC represents the remaining fragment of the photographically useful compound.

24. A composition according to claim 23 wherein the photographically useful compound comprises a developing agent, auxiliary developing agent, development accelerator, dye, fogging agent, silver halide solvent, coupler, compound which accelerates coupling reaction of couplers, bleaching accelerator, fixing accelerator, electron transfer agent, anti-fogging agent, keeping agent, sequestraint, chemical sensitizer or development inhibitor.

25. A composition according to claim 23 wherein the photographically useful compound comprises a photographic developer compound.

26. A composition according to claim 21 wherein PUC* represents a photographic developer compound of the formula ($R_3N^+—L—N^+R_3$) where each R is independently H or an organic substituent group and L represents a phenylene or an other linking group with conjugated double bonds.

27. A composition according to claim 26 wherein L represents a phenylene group.

28. A composition according to claim 21 wherein PUC* contains one or two onium ion groups.

29. A composition according to claim 21 wherein PUC* contains two onium ion groups, and the unit cell structure is of the formula $Ag_2X_6(PUC{:}2H^+)_2.H_2O$, where $PUC{:}2H^+$ represents the di-protonated form of the photographically useful compound.

30. A composition according to claim 21 wherein the unit cell structure is of the formula $Ag_2X_6$(N,N-diethyl-2-methyl-1,4-benzenediamine:$2H^+)_2.H_2O$.

31. A composition according to claim 21 wherein the unit cell structure is of the formula $Ag_2X_6$(para-phenylenediammine:$2H^+)_2.nH_2O$.

32. A composition according to claim 21 wherein PUC* contains two onium ion groups, and the unit cell structure is of the formula $Ag_2X_4(PUC{:}2H^+)$, where $PUC{:}2H^+$ represents the di-protonated form of the photographically useful compound.

33. A composition according to claim 21 wherein the unit cell structure is of the formula $Ag_2X_4$(N,N,N',N'-tetramethyl-1,4-benzenediamine:$2H^+$).

34. A composition according to claim 21 wherein PUC* contains one onium ion group, and the unit cell structure is of the formula $Ag_3X_7(PUC{:}H^+)_4$, where $PUC{:}H^+$ represents the protonated form of the photographically useful compound.

35. A composition according to claim 21 wherein PUC* contains one onium ion group, and the unit cell structure is of the formula $Ag_2X_4(PUC{:}H^+)_2$, where $PUC{:}H^+$ represents the protonated form of the photographically useful compound.

* * * * *